United States Patent [19]

Donenfeld

[11] Patent Number: 4,576,610

[45] Date of Patent: Mar. 18, 1986

[54] SUBLIMATION DYE TRANSFER PRINTING OF FABRICS

[75] Inventor: Henry Donenfeld, Melbourne, Australia

[73] Assignee: Doncroft Colors & Chemicals, Inc., Del.

[21] Appl. No.: 482,014

[22] Filed: Apr. 8, 1983

Related U.S. Application Data

[63] Continuation of Ser. No. 228,735, Jan. 27, 1981, abandoned.

[30] Foreign Application Priority Data

Mar. 25, 1980 [AU] Australia ..... PE2911

[51] Int. Cl.[4] ..... C09B 67/00

[52] U.S. Cl. ..... 8/471; 8/467; 8/557; 8/918

[58] Field of Search ..... 8/471, 468

[56] References Cited

U.S. PATENT DOCUMENTS

| | | | |
|---|---|---|---|
| Re. 27,892 | 1/1966 | Blake | 101/470 |
| 3,647,503 | 3/1972 | Mizutani et al. | 428/316.6 |
| 3,792,968 | 2/1974 | Rickenbacher et al. | 8/471 |
| 3,813,218 | 5/1974 | de Plasse | 8/471 |
| 3,829,286 | 8/1974 | Anzai et al. | 8/471 |
| 3,860,388 | 1/1975 | Haigh | 8/471 |
| 3,918,895 | 11/1975 | Mizuno | 8/468 |
| 3,922,445 | 11/1975 | Mizuno | 428/497 |
| 4,021,591 | 5/1977 | DeVries et al. | 8/471 |
| 4,027,345 | 6/1977 | Fujisawa et al. | 8/468 |
| 4,058,644 | 11/1977 | DeVries et al. | 8/471 |
| 4,066,810 | 1/1978 | Kosaka et al. | 428/207 |
| 4,072,462 | 2/1978 | Vellins et al. | 8/471 |
| 4,078,886 | 3/1978 | De Fago et al. | 8/471 |
| 4,088,440 | 5/1978 | Leimbacher et al. | 8/471 |
| 4,119,398 | 10/1978 | Purser | 8/496 |
| 4,167,392 | 9/1979 | Defago | 106/22 |
| 4,190,417 | 2/1980 | Prochaska et al. | 8/467 |
| 4,294,641 | 10/1981 | Reed et al. | 428/200 |
| 4,315,790 | 2/1982 | Rattee et al. | 428/200 |
| 4,351,871 | 9/1982 | Lewis | 8/468 |

FOREIGN PATENT DOCUMENTS

| | | |
|---|---|---|
| 2642350 | 3/1978 | Fed. Rep. of Germany . |
| 2832265 | 2/1979 | Fed. Rep. of Germany . |
| 2407826 | 7/1979 | France . |
| 53-98485 | 8/1978 | Japan . |
| 561818 | 5/1975 | Switzerland . |
| 578197 | 6/1946 | United Kingdom . |
| 1342304 | 1/1974 | United Kingdom . |
| 2049554 | 12/1980 | United Kingdom . |
| 1589292 | 5/1981 | United Kingdom . |

OTHER PUBLICATIONS

Vellins, C. E. in Venkataraman's "The Chemistry of Synthetic Dyes", vol. VIII, (Academic Press), 1978, pp. 191–193.

Chemical Abstracts, Citation No. 89:199040d (referring to Japan Kokai No. 78–98,485) Namura.

*Primary Examiner*—A. Lionel Clingman

*Attorney, Agent, or Firm*—Banner, Birch, McKie & Beckett

[57] ABSTRACT

This invention provides an improved method for sublimation dye transfer printing of a sublimable dye onto fabric by applied heat, comprising applying a composition comprising a polyester resin to the fabric, in which the polyester resin chemically bonds the dye to the fabric, to yield a fabric having a soft hand and deep color which is fast through repeated laundering. In preferred embodiments, the polyester resin has free carboxyl groups. In another embodiment, a conventional dye binder is also applied to the fabric. In a further modification, metallic glitter is added to the dye. The present invention also provides dye bonding compositions for bonding sublimable dyes to fabrics, and sublimation dye transfer printing elements incorporating the compositions of the invention.

18 Claims, 4 Drawing Figures

SUBLIMATION DYE TRANSFER PRINTING OF FABRICS

This application is a continuation, of application Ser. No. 228,735, filed Jan. 27, 1981, now abandoned.

FIELD OF THE INVENTION

This invention relates to sublimation dye transfer printing of fabrics. More particularly this invention relates to an improved method for sublimation dye transfer printing of fabrics made from natural and synthetic fibers, and particularly the printing of fabrics comprising cotton. The present invention also provides dye bonding compositions which permit sublimation dye transfer printing on fabrics whereby the printed fabrics have a soft texture and a deep color which is fast to repeated laundering. The invention further provides sublimation dye transfer printing elements, comprising the aforementioned novel dye bonding compositions which may be used to carry out sublimation dye transfer printing according to the invention.

DESCRIPTION OF THE PRIOR ART

It is well known in the art that great difficulty has been encountered in attempting to print cotton and other natural fiber fabrics by sublimation transfer of sublimable dyes. Attempts to print fabrics made from cotton or blends of cotton and synthetic fibers illustrate this difficulty. It may be shown, generally, that any fabric containing cotton and printed by sublimation dye transfer of sublimable dye without a special agent assisting in transfer or bonding of the dye to the fabric, will not satisfactorily be printed with the dye. For example, unaided sublimation dye transfer printing of a fabric consisting of cotton or a mixture of cotton and polyester fibers, say in a weight ratio of 35:65 respectively, results in totally unsatisfactory products with readily visible unprinted areas. If the cotton content of the fabric is lowered so that the ratio is 20:80, the graininess in the fabric coloration persists. Even if the ratio is changed to 10:90, so that only a very small fraction of the fabric consists of cotton fibers, the desirable fastness of the dye still is not achieved.

When well known dye binders are used in combination with sublimable dyes, fabrics made from natural fibers, including cotton, may be dyed, but the color produced is merely a stain, rather than fast color, and upon washing the dye is substantially removed from the fabric. While the binder may become bonded to the fabric, the dye is not.

Prior art methods have also included pretreatment or coating of either the fabric or a conventional sublimation transfer paper with various chemicals to enable fabrics containing cotton or other natural fibers to accept sublimable dyestuffs. However, all of these methods suffer from various disadvantages, and particularly with respect to the poor quality of the colors produced and unacceptably low fastness of the dyes to repeated washing.

GENERAL DESCRIPTION OF THE INVENTION

It has been found according to the present invention that polyester resins, preferably polyester resins in which the polymer has a substantial amount of free carboxyl groups, may be employed to markedly improve the depth, evenness and fastness of colors imparted by sublimation dye techniques even to fabrics exclusively made of cotton or other natural fibers. It is postulated that the polyester resin chemically bonds to the fabric, and provides active sites (such as free COOH groups) to which dye molecules may in turn bond. This discovery has marked a major breakthrough in terms of dye fastness, particularly where fabrics containing natural fibers such as cotton are printed by sublimation dye transfer. Indeed, employing this invention permits truly satisfactory sublimation dye printing on the important cotton fabrics for the first time.

While use of polyester resin application in accordance with the invention insures the fastness of sublimation transfer printed dyes on fabrics, stiffness of the printed products may be increased, and this may be undesirable in some applications. Additionally, the polyester resin may in some cases lack adequate film-forming properties to ensure fully-even bonding of the polyester to the fabric, a circumstance which may result in uneven dye bonding and unevenness of color in some instances. Any such difficulties may be remedied according to a preferred embodiment of the invention in which polyester resin is used in combination with a dye binder to facilitate even better sublimation dye transfer printing on fabrics and particularly on fabrics comprising cotton and other natural fibers. In this embodiment of the invention, the polyester and the dye binder act synergistically to further improve color depth and evenness, while still ensuring fastness to laundering. The usual dye binder has film-forming properties which result in more even uptake of the polyester resin and binder on the fabric, and also serves a plasticizing function to decrease the stiffness of the ultimate product. As indicated, the polyester resin provides active sites to which dye molecules may chemically bond to result in sublimation dye transfer printing which is fast to repeated laundering.

Accordingly it is a principal object of this invention to provide an improved method for sublimation dye transfer printing of sublimable dyes onto fabrics.

It is a further object of the invention to provide an improved method for sublimation dye transfer on fabrics containing natural fibers which results in enhanced color definition, depth and fastness.

It is another object of the invention to provide an improved method for sublimation dye transfer of improved color depth and fastness which results in a dyed fabric having a soft hand.

It also is an object of the invention to provide dye bonding compositions useful in facilitating the sublimation dye transfer and to produce a transfer of enhanced color depth and fastness.

It is an additional object to provide sublimation dye transfer printing elements comprising the dye bonding compositions which will produce improved transfers characterized by deeper color and enhanced color fastness.

It is a further object of the present invention to provide dye bonding compositions, sublimation dye transfer printing elements, and sublimation dye transfer printing methods for sublimation dye transfer printing of sublimable dyes onto fabrics comprising substantial amounts of cotton or other natural fabric.

Generally described, the present invention involves sublimation dye printing onto fabric by applied heat, and in which printing the applied dye composition comprises a polyester resin which chemically bonds the sublimed dye to the fabric and yields a dyed fabric having a soft hand and a deep, even color which is fast to repeated laundering. The invention includes both a novel dye composition and the method for its application. The present invention is particularly useful in the sublimation dye transfer printing of fabrics made from natural fibers, such as cotton, and blends of natural and synthetic fibers. The method and compositions of this invention produce for the first time a sublimation dye transfer fabric made of natural fiber or blends of natural and synthetic fibers characterized by intense, deep colors which will tolerate repeated laundering without dimming of color or loss of pattern definition.

The invention additionally provides sublimation dye transfer elements for applying a heat sublimable dye to a permanent substrate, comprising (A) a temporary supporting substrate; (B) a heat sublimable dye supported by the temporary substrate; and (C) a bonding composition of the invention supported by the temporary substrate; and composition upon heat transfer to a permanent substrate effecting a secure bond between the dye and the permanent substrate.

In accordance with a further embodiment of the invention metallic glitter may be added to the dye composition.

DETAILED DESCRIPTION OF THE INVENTION

Figure 1:
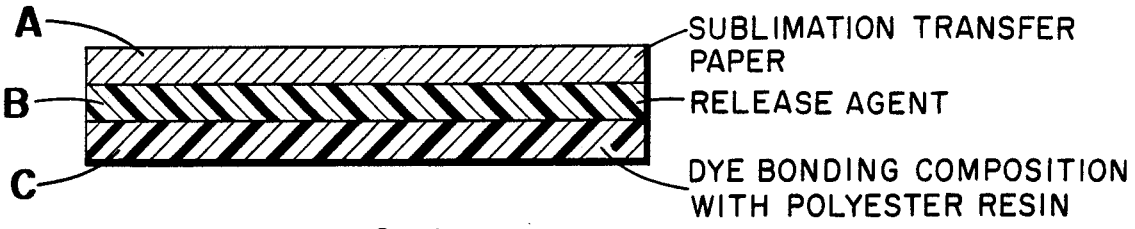
FIG. 1 is a cross-sectional diagram of one type of sublimation dye transfer printing element made in accordance with the present invention.

According to the present invention, dye bonding compositions, sublimation dye transfer printing elements and sublimation dye transfer printing methods are provided which markedly improve the depth and evenness of colors imparted to fabrics (especially those containing cotton or other natural fiber) by sublimation dye transfer printing, as well as ensuring color fastness.

The dye bonding compositions of this invention comprise a polyester resin preferably having a substantial amount of free carboxyl groups. While it is not desired that applicant be bound by the theory expressed, it is believed that the active carboxyl groups aid in bonding the polyester resin to the fabric and additionally provide active sites to which dye molecules may chemically bond to form colors which are fast to repeated laundering.

The polyester resin employed in this invention may be any polyester resin which will not otherwise adversely affect the dyeing process or the printed product. Factors such as resin glass transition temperature, resin color, and resin cost may be evaluated by those skilled in the art to select polyester resins for use in particular applications of the invention. The invention will be described in connection with polyesters of the type having free carboxyl groups. However, it will be understood that satisfactory products may also be obtained using a polyester having substantially no free carboxyl groups. Better products are normally produced using polyesters having free carboxyl groups, because there are more active sites for binding to fabric and dyes.

Among the preferred polyesters are poly(ethylene adipate), poly(ethylene suberate), poly(ethylene sebacate), poly(tetramethylene adipate), poly(hexamethylene maleate), poly(hexamethylene fumarate), poly(hexamethylene succinate), poly(hexamethylene sebacate), poly(decamethylene adipate), poly(hexadecamethylene sebacate), poly(1,4-cyclohexylene sebacate) and poly(ethylene terephthalate). Dacron (a dimethylterephthalate-ethylene glycol reaction product) also may be used. Other polyester polymers having ester linkages may be employed including polycarbonates such as bis-hydroxyphenylpropylene polycarbonate (sold under the trade name LEXAN).

In one embodiment of the invention, the polyester resin is an alkyd-type resin containing substantially no free oil. Alkyd resins may be formed as reaction products of a polyhydric alcohol and a polybasic acid in the presence of a drying oil which enters into the reaction and acts as a modifier of the polymer. Other types of polyesters also may be used. Polyesters may be formed, for example, by the reaction of a polyhydric alcohol with a polybasic acid halide, or by the polymerization of a hydroxy carboxylic acid. Preferably a drying oil is included in the monomer solution prior to polymerization so that an alkyd polyester is produced. Polymers having polyester linkages and also having other types of polymer linkages may also be used, as long as the polyester linkages remain reactive. Examples of polyhydric alcohols which may be used in producing the polyester resin include aliphatic hydrocarbon glycols such as ethylene glycol, propylene glycol, and glycerol. Others will occur to those skilled in the art. Polybasic acids which may be used include, as preferred examples, aromatic and aliphatic carboxylic polyacids and anhydrides, and their mixtures. Specific polyacids which are suitable include, as examples, phthalic acid, isophthalic acid, terephthalic acid, maleic acid, succinic acid and adipic acid, and the corresponding anhydrides. Acid halides which may be used are those known in the art, such as the acid chlorides of the aromatic and aliphatic acids listed above. Hydroxy acids which may be used include those formed by 1:1 condensation of a polybasic acid with a polyhydric alcohol, for example, terephthalic acid and propylene glycol. Others will occur to those skilled in the art. Drying oils which may be used include natural and artificial drying oils such as linseed, soybean and tung oils. Linseed oil is preferred.

Production of the polyester resin may be carried out by simply allowing the selected monomers, such as a mixture of a polyhydric alcohol, a polybasic acid, and a drying oil to react at a high temperature, for example, at about 350° to 450° F., for about 10 seconds. If it is desired to produce a polyester resin having substantially no free carboxyl groups, extended reaction times with applied heat are necessary. The basic techniques for these polymerizations are well known in the art. Residual drying oil, if any, should be removed from the product polyester resin, because it may interfere with the transfer of the dye onto the fabric.

If desired, a conventional dye binder may be added to the dye bonding composition. In this case, the polyester resin and the conventional dye binder react to form a cross-linked polymer, and act cooperatively and synergistically to improve color depth and evenness in product fabrics, while ensuring satisfactory fastness of the sublimation transfer printed dye to repeated laundering.

The conventional dye-binder is generally a self-crosslinking, crosslinkable or heat-sealable polymer having a glass transition temperature which is low enough so that the fabric treated by it is not rendered unacceptably stiff. However, the glass transition temperature should be high enough so that the dye bonding composition does not remain tacky after application to the fabric. Broadly, the glass transition temperature of the binder may range from −30° to +40° C., preferably from −2° to +5° C.

Preferable dye binders include polymers of one or more monomers selected from the group consisting of unsaturated aliphatic hydrocarbons, acrylic acid esters, methacrylic acid esters, and compounds derived from a vinyl halide. For example, polyisobutylene, polymethacrylate, and vinyl propionate polymers may be used. Specific copolymers which may be used include copolymers of methacrylate and vinyl isobutyl ether, methyl methacrylate and vinyl isobutyl ether, methyl acrylate and ethyl acrylate, butyl acrylate and ethyl acrylate, butyl acrylate and vinyl acetate, methacrylate and butyl acrylate, butyl acrylate and butyl methacrylate, vinyl acetate and ethylene, vinyl chloride and ethylene, and styrene with 1,3-butadiene. Terpolymers such as a reaction product of a monomer mixture including acrylonitrile, 1,3-butadiene and styrene may be used. The preferred binders are polymers of one or more acrylates, optionally having been copolymerized with other types of monomers.

Normally, the polyester resin and conventional dye binder are combined in a weight ratio such that more than 50% of the combined weight of polyester resin and dye binder is polyester resin. Where more conventional dye binder than polyester resin is used, the dye bonding composition may tend to stick to release paper surfaces, rendering sublimation dye transfer printing difficult. Weight ratio ranges are otherwise best determined on a case by case basis by evaluation of (1) difficulty of release of layers of the dye bonding composition from selected release surfaces, and (2) properties of resulting sublimation dye transfer products, including dye fastness, color depth and fabric stiffness. Increasing the weight fraction of polyester resin in the dye bonding composition generally improves color depth and dye fastness, but there is usually an attendant increase in fabric stiffness. These factors may be evaluated and appropriate dye bonding composition formulations made by those skilled in the art on a case by case basis.

If desired, a hardener may be combined with the polyester resin and conventional dye binder in the dye bonding composition of the invention to improve curing of the composition after application to the fabric which is being sublimation dye transfer printed. While it is usually not necessary to include a hardener in the composition, color fastness is usually improved when a hardener is added. Examples of suitable hardeners include isocyanates, epoxides, melamine-formaldehyde, and urea-formaldehyde. Triglycidylisocyanurate is preferred. Other hardeners will occur to those skilled in the art.

A thickener may be added to the composition to achieve the desird viscosity. Examples of thickeners which may be used include polyacrylates and cellulose ethers, such as sodium polyacrylates and other polymeric acrylic salts, carboxymethylcellulose (CMC) and carboxymethylhydroxyethyl cellulose (CMHEC). Suitable thickeners are commercially available under the trade name Acrysol from Rohm and Haas. Other thickeners will occur to those skilled in the art.

The dye bonding composition advantageously may also comprise a humectant, which will take up moisture from the environment. Such a lubricant agent improves the smoothness of applied layers of dye bonding composition, decreases the film-forming tendencies of the composition so that it may be applied to a substrate by silk-screening methods without clogging the screen, and decreases the resistance of a dry layer of the composition to release from a desired temporary support, i.e., release paper. Suitable humectants include liquid polyols such as alkylene glycols, alkyl glycols, poly(alkylene oxide)glycols, poly(hydroxyalkyl)cycloalkanes, and hydroxylated aliphatic amides. The preferred humectant is glycerin.

The dye bonding composition preferably includes a small amount of a dispersing agent which stabilizes the suspension of the ingredients in the dye bonding composition. While dispersing agents are conventional, and may be selected by those skilled in the art for particular applications, metal salts of naphthalenesulfonic acid are preferred.

The dye bonding composition may include a small amount of a water-soluble anti-foaming agent, such as a silicone anti-foaming agent. Anti-foaming agents preferably will be incorporated in the dye bonding composition in an amount of about 0.3% of the total weight of the composition.

If desired, an inert diluent may be added to the dye bonding composition to downwardly adjust viscosity. Water is the preferred diluent.

In order to produce the dye bonding compositions of the invention, the polyester resin as well as optional ingredients including dye-binders, hardeners, humectants, thickeners, dispersing agents, anti-foam agents and inert diluents are combined.

The dye bonding compositions of the invention are particularly useful to improve sublimation dye transfer printing on fabrics.

Broadly, the sublimation dye transfer printing method of the invention comprises applying a sublimable dye and a polyester resin (preferably having free carboxyl groups) to fabric by transfer induced by heat, in which the polyester resin bonds the dye to the fabric. The dye is transferred by sublimation; the polyester resin is transferred by physical migration induced by the applied heat. As long as the polyester is permitted to bond to the fabric before the dye contacts exposed fabric not treated with the polyester, any application methods may be used. The basic concepts of sublimation dye transfer printing are well known by those skilled in the art.

In a preferred embodiment of the invention, a conventional dye-binder is added to the dye bonding composition. The dye bonding composition will be referred to henceforth in accordance with this preferred embodiment; however, it is to be understood that the invention may be effectively practiced without the use of any conventional dye-binder.

In accordance with the above discussion of the dye bonding compositions of the invention, additional agents including hardeners, thickeners, humectants, dispersing agents, anti-foam agents and inert diluents may be added as desired. These additives may be selected on a case by case basis by those skilled in the art.

Dye uptake, and strength of the resulting color in a fabric is proportional to the uptake of the polyester resin and dye-binder. Hence, greater uptake of polyester and dye binder results in deeper colors and better color fastness overall. However, increasing uptake of polyester leads to stiffer fabric, and the desired flexibility and "hand" of the ultimate products should be established in order to determine maximum acceptable polyester uptake levels.

In some cases it may be desirable to separate the polyester resin from the remainder of the dye bonding composition prior to sublimation dye transfer printing, and permit the polyester resin to combine with the remaining ingredients in the dye bonding composition during the transfer process. Embodiments of the invention wherein such procedures are followed will be detailed below. This mode of operation results in the production of equally satisfactory printed fabrics.

A wide variety of fabrics including both woven and nonwoven fabrics may be printed by sublimation dye transfer printing according to the invention, including cotton, wool, linen, cotton-polyester blends, polyester-rayon blends, rayon, nylon, acetates and acrylates. The invention is of particular utility in sublimation dye transfer printing of cotton fabrics and fabrics made from blends of cotton with other fibers. The invention may be practiced using 100% polyester fabrics if desired, but will normally produce no substantial improvement in dye bonding quality. The invention is not limited to the above-mentioned fabric types, and those skilled in the art will be able to quickly determine applicability of the invention to other fiber types.

Any sublimable dye known to those skilled in the art to bond effectively and satisfactorily to polyester may be used in practicing the invention. Preferred are disperse dyes, listed in the *Colour Index* under the heading "Disperse Dyes." These dyes may include, for example, azo, anthraquinone, quinophthalone, nitro, azomethine, and styryl-type dyes.

In one method of applying the dye bonding compositions of the invention to fabrics, the compositions are incorporated into sublimation dye transfer printing elements which may be used to print dyes on fabrics. Such sublimation dye transfer printing involves transferring the dye and the dye bonding composition onto the fabric from a substrate such as a release paper, by placing the face of a substrate coated with the ingredients to be transferred against the fabric to be sublimation dye transfer printed, and applying heat to the other side of the substrate to sublime the dye and physically transfer the dye bonding composition from the substrate onto the fabric. While release papers are advantageously employed in such processes, they are not necessary. If desired, pressure may be applied to the assembly of (1) transfer element, and (2) fabric, to aid in facilitating the transfer. Also, heat can be applied to the free side of the fabric rather than the free side of the substrate, to heat the entire assembly. Since this requires more heating, it is less preferred.

The sublimation dye transfer printing process may be effected at a temperature ranging from 350° to 420° F., applied for 10 seconds; preferably, the temperature used ranges from 400° to 405° F., applied for 10 seconds. More strenuous heat treatment may result in penetration of the dye into the fibers of the fabric, with a resultant decrease in the ultimate color depth of the product. The fabric and transfer element are preferably compressed together with an applied pressure (psi) of at least 10 pounds per square inch, more preferably at least 40 psi, but this is not essential to operation.

One embodiment of a transfer element of the invention is shown in FIG. 1. A sublimation transfer paper (A) is coated on one face with a release agent (B); a layer (C) of the dye bonding composition of the invention is then deposited over the layer (B) of release agent.

Where the release agent used is a polyethylene emulsion, the dye layer may be interposed between layers (A) and (B), because the release agent layer (B) and the dye will both transfer onto the fabric. All release agents which are transferred onto the fabric will be referred to as "Class 1" agents. However, no release agents other than polyethylene emulsions are known at present to act in this manner. Other release agents ("Class 2") do not transfer with the dye onto the fabric; when they are used, the dye must, according to this embodiment, be deposited between layers (B) and (C). Alternatively, the dye may be mixed with the dye bonding composition as layer (C); this embodiment may be used regardless of the type of release agent employed.

Figure 2:
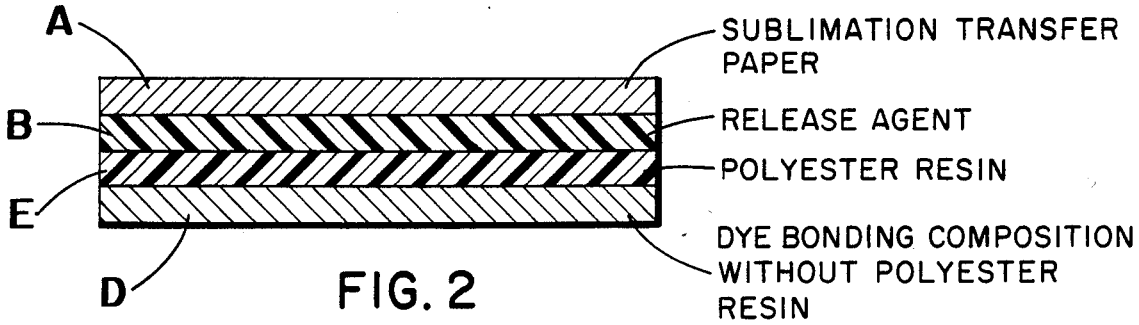
FIG. 2 is a cross-sectional diagram of another embodiment of a sublimation dye transfer printing element made in accordance with the present invention.

If desired, as shown in FIG. 2, the polyester resin may be omitted from the dye bonding composition and is instead deposited after application of layer (B) and before application of layer (D) of dye bonding composition without polyester resin, to form intermediate layer (E).

Where Class 1 release agents are used, the dye layer again may be deposited between layers (A) and (B); where Class 2 release agents are used, the dye layer must be deposited between layers (B) and (E).

Figure 3:
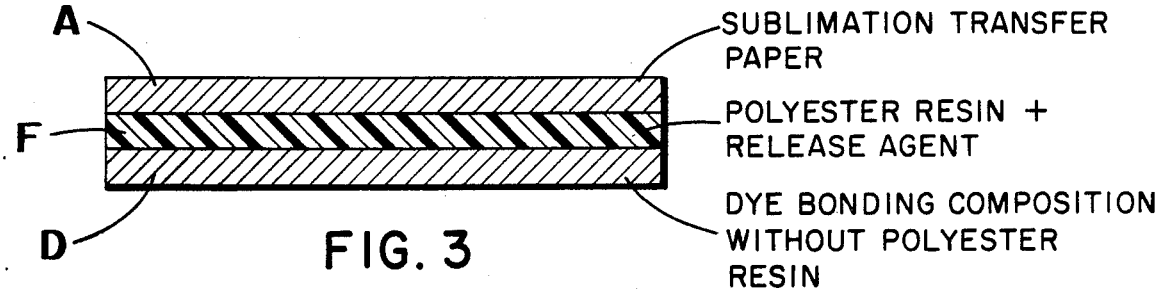
FIG. 3 is a cross-sectional diagram of yet another embodiment of a sublimation dye transfer printing element made in accordance with the present invention.

In another embodiment shown in FIG. 3, the polyester resin is combined with the release agent and the mixture is applied to the sublimation transfer paper (A) to form layer (F). The dye bonding composition again without the polyester resin is deposited over layer (F) as layer (D). This embodiment may only be used with Class 1 release agents.

In using the above described transfer elements, the free face of the conventional dye binder-containing layer is applied to the fabric surface to be sublimation dye transfer printed, and heat is applied to effect sublimation transfer of the dye and physical transfer of the dye bonding composition ingredients.

Figure 4:
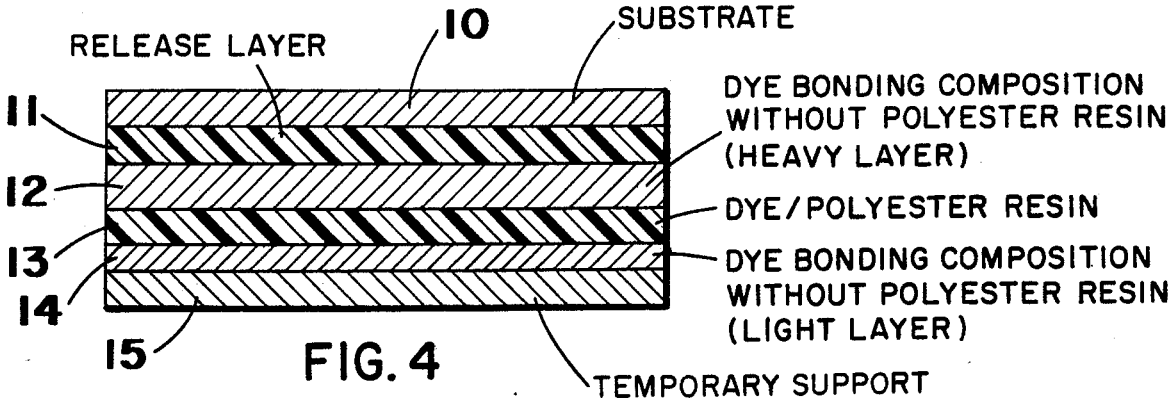
FIG. 4 is a cross-sectional diagram of still another embodiment of a sublimation dye transfer printing element made in accordance with the present invention.

FIG. 4 illustrates another embodiment of a sublimation dye transfer printing element according to the invention. Substrate layer 10 is coated on one face with a release layer 11. Over the release layer 11 is applied a heavy coating of dye bonding composition 12 without polyester resin. The dye layer 13, applied over it, contains the necessary amount of polyester resin. A light layer 14 of dye bonding composition without polyester resin is applied over the dye/polyester resin layer 13, having sufficient bonding strength to retain a temporary support 15 until it is desired to remove the support. The substrate 10 with the release layer 11 is removed when it is desired to effect sublimation dye transfer printing, and the open face of the heavy dye bonding composition layer 12 is applied to the fabric surface to be printed. Heat is applied and sublimation dye transfer printing is effected. The temporary support 15 is then removed and discarded.

The sublimation dye transfer paper may comprise any suitable sheet material which is relatively non-porous and substantially impervious to the release layer and dye bonding composition ingredients. For example, the sublimation dye transfer paper may comprise paper, fiberglass cloth, plastic film, metal foil, or a woven or non-woven fabric. Other materials which may be used will occur to those skilled in the art.

Examples of suitable release agents include silicones and waxes; polyethylene emulsions as discussed above are preferred. In addition to permitting dye migration, polyethylene emulsions result in less glossy, higher-quality printed fabric surfaces.

The thickness of coatings of dye bonding composition layers to be used in sublimation dye transfer printing elements may be determined by experimentation. Thicker layers give greater uptake of the dye bonding composition agents. Higher degrees of dye bonding composition uptake result in deeper colors. However, high uptake levels result in stiffer fabrics. The balance between these countervailing considerations may be determined by one skilled in the art on a case-by-case basis.

The following Examples illustrate the use of dye bonding compositions made according to the present invention in sublimation dye transfer printing of various fabrics. These Examples are merely illustrative, and the invention is not limited to their teachings. Conventional sublimation dyes were employed in the examples. The amount of dye used in any specific instance will depend on the particular tint desired and will be employed as understood by those skilled in the sublimation dye transfer art. The particular dye or amount of dye employed is optional. Any of the polyester resins specifically disclosed or other suitable polyester (preferably with free carboxyl groups) may be employed in the exemplified compositions.

EXAMPLE 1

A dye bonding composition is formulated from the following ingredients in percent proportion by weight:

27% poly(ethylene adipate) resin having 10% triglycidylisocyanurate hardener by weight
10% acrylate binder
9% glycerin
4.5% TT678 Acrysol thickener
0.3% silicone anti-foam agent
1% dispersing agent (metal salt of naphthalenesulfonic acid)
48.2% water The dye bonding composition is coated on a release paper having a layer of sublimable dye, through a screen (mesh number 29(74), having 29 holes per linear centimeter, and 74 holes per linear inch), to produce a sublimation dye transfer printing element.

EXAMPLE 2

A dye bonding composition is formulated from the following ingredients in percent proportion by weight:

26% poly(hexamethylene maleate) resin having 10% triglycidylisocyanurate hardener by weight
7% acrylate binder
8% glycerin
4% Acrysol TT678 thickener
0.3% silicone anti-foam agent
54.7% water The dye bonding composition is coated on a release paper having a layer of sublimable dye, through a screen (mesh number 29(74)), to produce a sublimation dye transfer printing element.

EXAMPLE 3

Sublimation dye transfer printing elements produced according to Examples 1 and 2 are tested on 50/50 polyester:cotton and 50/50 acrylic:cotton (weight ratio blend) fabrics by applying the free face of the dye bonding composition layer to the fabric and applying heat to maintain the assembly at about 400° F. for about 10 seconds. The resulting printed fabrics are observed to have excellent color depth, good fastness properties and a hand that becomes soft after one washing or upon flexing the fabric after the transfer.

EXAMPLE 4

A dye bonding composition is formulated from the following ingredients:

| | |
|---|---|
| 200 | grams poly(ethylene terephthalate) having 10% triglycidylisocyanurate hardener, by weight |
| 40 | grams Acrysol TT678 thickener |
| 3 | grams silicone anti-foam agent |
| 757 | grams water |
| 1,000 | grams Total |

The dye bonding composition is coated on a release paper having a layer of sublimable dye, through a screen (mesh number 29(74)), to produce a sublimation dye transfer printing element.

EXAMPLE 5

Sublimation dye transfer printing elements produced according to Example 4 are tested on 65/35 polyester:cotton and 50/50 polyester:cotton (weight ratio blend) fabrics by applying the free face of the dye bonding composition layer to the fabric and applying heat to maintain the assembly at about 400° F. for about 10 seconds. Application to a polyester-cotton fiber blend of weight ratio 65:35, produces a sublimation dye transfer print having good color yield, good hand and good fastness properties. Printing on a polyester-cotton blend of weight ratio 50:50, produces a sublimation dye transfer print having good hand and fair fastness properties but with less satisfactory color yield.

EXAMPLE 6

The dye bonding composition in Example 4 is modified so that 250 grams of poly(ethylene terephthalate) resin with the same weight fraction of triglycidylisocyanurate hardener is use. Sublimation dye transfer printing elements are prepared in a similar manner as in Example 4. Sublimation dye transfer prints are produced on a polyester-cotton 50:50 (weight ratio blend) fabric, with slight improvement of the color yield and better fastness properties over the results on the same fabric in Example 4.

EXAMPLE 7

The amount of poly(ethylene terephthalate) resin used in the dye bonding composition of Example 4 is further increased to 300 grams, again with 10% triglycidylisocyanurate hardener by weight in the polyester resin. Sublimation dye transfer printing elements are prepared in a similar manner as in Example 4. Sublimation dye transfer prints are produced on a 100% cotton fabric. The printed fabric is observed to have good color depth, satisfactory color fastness and good hand.

EXAMPLE 8

A dye bonding composition is formulated from the following ingredients:

| | |
|---|---|
| 350 | grams poly(ethylene terephthalate) resin having 10% triglycidylisocyanurate hardener by weight |

-continued

| | |
|---|---|
| 30 | grams Acrysol TT678 |
| 3 | grams anti-foam-B |
| 617 | grams water |
| 1,000 | grams Total |

The dye bonding composition is coated on a release paper having a layer of sublimable dye, through a screen (mesh number 29(74)), to produce a sublimation dye transfer printing element.

EXAMPLE 9

Sublimation dye transfer printing elements produced according to Example 8 are tested on 50/50 polyester:-cotton (weight ratio blend) fabric by applying the free face of the dye bonding composition layer to the fabric and applying heat to maintain the assembly at about 400° F. for about 10 seconds. The sublimation dye transfer prints exhibit good color yield, good fastness properties, and a softer hand than in Example 7.

EXAMPLE 10

A dye bonding composition is formulated from the following ingredients:

| | |
|---|---|
| 220 | grams poly(hexadecamethylene sebacate) resin having 10% triglycidylisocyanurate hardener by weight |
| 160 | grams acrylate binder (Valbond 6052, Valchem Corporation), having a glass transition temperature of −17° C.) |
| 40 | grams Acrysol TT678 thickener |
| 3 | grams anti-foam-B |
| 577 | grams water |
| 1,000 | grams Total |

The dye bonding composition is coated on a release paper having a layer of sublimable dye, through a screen (mesh number 29(74)), to produce a sublimation dye transfer printing element.

EXAMPLE 11

Sublimation dye transfer printing elements produced according to Example 10 are tested on 65/35 polyester:-cotton and 50/50 polyester:cotton (weight ratio blend) fabrics by applying the free face of the dye bonding composition layer to the fabric and applying heat to maintain the assembly at about 400° F. for about 10 seconds. The printed fabrics are observed to have good color depth and good fastness, but remain slightly tacky.

EXAMPLE 12

A dye bonding composition is prepared from the following ingredients:

| | |
|---|---|
| 250 | grams poly(tetramethylene adipate) resin having 10% triglycidylisocyanurate hardener by weight |
| 100 | grams Valbond 6052 binder |
| 35 | grams Acrysol TT678 thickener |
| 3 | grams anti-foam-B |
| 612 | grams water |
| 1,000 | grams Total |

The dye bonding composition is coated on a release paper having a layer of sublimable dye, through a screen (mesh number 29(74)), to produce a sublimation dye transfer printing element.

EXAMPLE 13

Sublimation dye transfer printing elements produced according to Example 12 are tested on 65/35 polyester:-cotton and 50/50 polyester:cotton (weight ratio blend) fabrics by applying the free face of the dye bonding composition layer to the fabrics and applying heat to maintain the assembly at about 400° F. for about 10 seconds. The printed fabrics are observed to have good overall properties; color depth, fastness and hand are all satisfactory, and the printed fabrics are not tacky.

EXAMPLE 14

A dye bonding composition is prepared from the following ingredients:

| | |
|---|---|
| 260 | grams poly(1,4-cyclohexylene sebacate) alkyd polyester resin having 10% triglycidylisocyanurate hardener by weight (and including a conventional amount of linseed oil) |
| 100 | grams acrylate binder having a glass transition temperature of −2° C. (Valbond 6063, Valchem Corporation) |
| 35 | grams Acrysol TT678 thickener |
| 3 | grams anti-foam-B |
| 602 | grams water |
| 1,000 | grams Total |

The dye bonding composition is coated on a release paper having a layer of sublimable dye, through a screen (mesh number 29(74)), to produce a sublimation dye transfer printing element.

EXAMPLE 15

Sublimation dye transfer printing elements produced according to Example 14 are tested on 50/50 polyester:-cotton (weight ratio blend) fabric by applying the free face of the dye bonding composition layer to the fabric and applying heat to maintain the assembly at about 400° F. for about 10 seconds. The printed fabric is observed to have good color depth, satisfactory fastness and soft hand.

EXAMPLE 16

A dye bonding composition is prepared from the following ingredients:

| | |
|---|---|
| 260 | grams poly(ethylene sebacate) alkyd resin having 10% triglycidylisocyanurate hardener by weight (and including a conventional amount of linseed oil) |
| 100 | grams Valbond 6063 binder |
| 35 | grams Acrysol TT678 |
| 100 | grams glycerin |
| 3 | grams anti-foam-B |
| 502 | grams water |
| 1,000 | grams Total |

The dye bonding composition is coated on a release paper having a layer of sublimable dye, through a screen (mesh number 29(74L)), to produce a sublimation dye transfer printing element.

EXAMPLE 17

Sublimation dye transfer printing elements produced according to Example 16 are tested on 100% cotton and 50/50 polyester:cotton (weight ratio blend) fabrics by applying the free face of the dye bonding composition layer to the fabric and applying heat to maintain the assembly at about 400° F. for about 10 seconds. The results overall are good for both fabric types: color depth, fastness and hand are all satisfactory. Comparatively, the color fastness is better on the 50/50 polyester:cotton blend fabric, but the hand is slightly stiffer.

EXAMPLE 18

A dye bonding composition is prepared from the following ingredients in percent proportion by weight:

27% polyester resin having 4 to 10% free carboxyl groups (relative to total carboxyl groups available prior to resin formation), and having 10% epoxy hardener by weight (such a polyester resin is commercially available from the Schenectady Chemical Co. under the identification code number XPC-289-1-00833)
10% acrylate binder
9% glycerin
0.3% silicone anti-foam agent
4.5% TT678 Acrysol thickener
1% dispersing agent (metal salt of naphthalenesulfonic acid)
48.2% water The dye bonding composition is coated on a release paper having a layer of sublimable dye, through a screen (mesh number 29(74)), to produce a sublimation dye transfer printing element.

EXAMPLE 19

A dye bonding composition is prepared from the following ingredients in percent proportion by weight:

27% polyester resin having 40 to 60% free carboxyl groups (relative to total carboxyl groups available prior to resin formation), and having 10% triglycidyl isocyanurate epoxy hardener by weight (such a polyester resin is commercially available from the Schenectady Chemical Co. under the identification code number XPC-539-00901)
10% acrylate binder
9% glycerin
4.5% TT 678 Acrysol thickener
0.3% silicone anti-foam agent
1% dispersing agent (metal salt of naphthalenesulfonic acid)
48.2% water The dye bonding composition is coated on a release paper having a layer of sublimable dye, through a screen (mesh number 29(74)), to produce a sublimation dye transfer printing element.

EXAMPLE 20

Sublimation dye transfer printing elements produced according to Examples 18 and 19 are tested on 100% cotton fabrics by applying the free face of the dye bonding composition layer to the fabric and applying heat to maintain the assembly at about 400° F. for about 10 seconds. The resulting printed fabrics are observed to have excellent color depth, good fastness properties and a hand that becomes soft after one washing or upon flexing the fabric after the transfer. Comparatively, the dyed fabric produced using the transfer element from Example 19 demonstrated superior wash fastness to that produced using the transfer element from Example 18, but the fabric was found to be slightly stiffer than the dyed fabric produced using the transfer element from Example 18.

While it is desirable to incorporate the dye bonding compositions of the invention into sublimation dye transfer printing elements which may be conveniently used to effect sublimation dye transfer printing, the invention may be practiced by merely impregnating the subject fabric surface with the dye bonding composition, and then applying a conventional sublimation dye transfer printing element (for example, a release paper having a dye layer on the release surface), to the treated fabric to effect sublimation dye transfer printing. However, stiffness of the ultimate product increases with increasing uptake of the dye bonding composition, and simple impregnation methods of application of the dye bonding composition may result in greater uptake than the above-outlined methods. Hence, simple impregnation treatment is a less-preferred mode of operation as it usually leads to stiffer products. Better results may be achieved by printing only the areas of a fabric corresponding to the dye design to be transferred: the total amount of dye bonding composition used is thus reduced.

It will be understood that the dye bonding compositions of the invention may be applied by one of ordinary skill in the art using any desired method; the specific methods and transfer elements disclosed above are nonlimiting examples of application means and methods.

In one embodiment of the invention, methods and transfer elements are provided for applying glitter to fabrics. The prior art has included several different approaches to carrying out this type of fabric decoration.

One refinement achieved in the 1950's was the production of glossy and metallic, e.g., silver effects on fabrics by applying metal salts by conventional printing techniques. Aluminum salts were used extensively, by screening a suitable uncured, wet adhesive onto the fabric and then sprinkling aluminum salt powder onto the wet adhesive.

Further progress was made more recently by substituting high-gloss synthetic plastic particles for the metal salts, and employing plastisol adhesives. The main disadvantages of using this technology are that (1) the system is limited to applying nonmetallic colors, and (2) the products lack acceptable flexibility and elasticity, causing the plastisols to crack, thus releasing the glitter particles.

According to the present invention, any desired glitter material, including glitter having metallic and nonmetallic colors, may be applied to a fabric by sublimation dye transfer printing. Additionally, metallic glitter may be used in combination with a heat-transferable dye such as a sublimable dye so that the glitter and dye together produce a metallic color or any desired hue, for example, metallic red, blue or green, on the fabric. Glitter may be produced by any means known in the art. For example, metallic glitters may be produced by electroless deposition of metals on plastic particles, or on plastic sheeting which is then cut into particles.

The flexibility and elasticity of the resulting prints are such that even if the fabric is a knit and is stretched to its maximum flexibility, there is no cracking of the prints. The fastness of the colors to washing is very good and the process lends itself to application on synthetic as well as natural fibers and blends thereof.

The following Examples are provided to illustrate this aspect of the present invention, and are intended to be merely illustrative and nonlimiting.

EXAMPLE 21

A sheet of paper is coated on one side with a polyethylene emulsion to form a release paper. The release surface resulting after the polyethylene emulsion dries is coated with a composition comprising (a) an acrylic binder; (b) an alkyd polyester produced from a monomer mixture of ethylene glycol, terephthalic acid and linseed oil; (c) glitter consisting of plastic particles coated by conventional electroless deposition with aluminum metal; (d) a sublimable blue dye; and (e) a thickener.

The transfer element thus produced is used to apply a metallic blue design to a 100% cotton fabric. The transfer element is placed over the fabric with the coating facing toward the fabric. Heat is applied to bring the assembly of fabric and transfer element to a maximum temperature of about 350° to 420° F., which is maintained for about 10 seconds. Upon cooling, the printed fabric is observed to have a glossy metallic blue color, and is easily flexed without cracking of the coating.

EXAMPLE 22

Using the same release paper, a different type of transfer element is prepared. First, a thick layer of a dye bonding composition comprising the polyester resin, acrylic binder and carboxymethylcellulose thickener used in Example 18, sufficient to bond all of the aluminum glitter and sublimable blue dye to be transferred to the fabric is applied to the release coat of the release paper. Next, the glitter and dye are sprinkled on the dye bonding composition layer. Then, a second layer of dye bonding composition only sufficient to temporarily adhere to a second release paper is applied, and a second release paper is placed over the thin coating of dye bonding composition and adhered. Upon removal of the first release paper, a transfer element is produced ready for use. The transfer element is applied to an all-cotton fabric as in Example 18, and with similar results.

While the preferred embodiments of this invention have been discussed herein, those skilled in the art will appreciate that changes and modifications may be made without departing from the spirit and scope of this invention, as defined in and limited only by the scope of the appended claims.

I claim:

1. In a one step method for sublimation dye transfer printing of a sublimable dye onto fabric by applied heat from a sublimation dye transfer paper the improvement comprising applying a composition comprising a polyester resin having free carboxyl groups, a hardener and a dye binder which is a polymer of one or more monomers selected from the group consisting of unsaturated aliphatic hydrocarbons, acrylic acid esters, methacrylic acid esters, vinyl chloride, vinyl propionate, vinyl isobutyl ether, vinyl acetate, styrene and acrylonitrile, by transfer from the sublimation dye transfer paper to the fabric, in which the polyester resin securely bonds the dye to the fabric to yield a fabric having a soft hand and deep color which is fast to repeated laundering.

2. The method of claim 1 where the hardener is selected from a group consisting of isocyanates, epoxides, melamine-formaldehyde and urea-formaldehyde.

3. The method of claim 1 where the composition contains more polyester resin by weight than dye-binder.

4. The method of claim 1 where the dye binder is a polymer of one or more monomers selected from the group consisting of ethylene, isobutylene, 1,3-butadiene, methyl acrylate, ethyl acrylate, butyl acrylate, methyl methacrylate, butyl methacrylate, vinyl chloride, vinyl acetate, vinyl propionate, vinyl isobutyl ether, styrene, and acrylonitrile.

5. The method of claim 1 where the composition comprises a humectant.

6. The method of claim 1 in which the composition contains a particulate decorative glitter which yields a glitter coating on the printed fabric.

7. A sublimable dye transfer printing composition for transfer of the dye onto a fabric by applied heat which comprises a polyester resin having free carboxyl groups, a dye binder and a hardener, said polyester resin securely bonding the dye to the fabric to yield a dyed fabric having soft hand and color fastness after repeated laundering, where said dye binder is a polymer of one or more monomers selected from the group consisting of unsaturated aliphatic hydrocarbons, acrylic acid esters, methyl acrylic acid esters, vinyl chloride, vinyl propionate vinyl isobutyl ether, vinyl acetate, styrene and acrylonitrile.

8. The composition of claim 7 where the dye binder is a polymer of one or more monomers selected from the group consisting of ethylene, isobutylene, 1,3-butadiene, methyl acrylate, ethyl acrylate, butyl acrylate, methyl methacrylate, butyl methacrylate, vinyl chloride, vinyl acetate, vinyl propionate, vinyl isobutyl ether, styrene and acrylonitrile.

9. A sublimation dye transfer element for applying a heat sublimable dye to a permanent substrate comprising:

(a) a temporary supporting substrate;

(b) a sublimable dye supported by the temporary substrate;

(c) a layer comprising a mixture of a polyester resin having free carboxyl groups and a polyethylene emulsion release agent supported by the dye; and (d) a layer containing a dye binder and a hardener disposed on the layer comprising said polyester resin and release agent, where the dye binder is a polymer of one or more monomers selected from the group consisting of unsaturated aliphatic hydrocarbons, acrylic acid esters, methyl acrylic acid esters, vinyl chloride, vinyl propionate, vinyl isobutyl ether, vinyl acetate, styrene and acrylonitrile.

10. A sublimation dye transfer element according to claim 9 in which the layer containing the dye binder and the hardener also includes a humectant.

11. In a one step method for sublimation dye transfer printing of a sublimable dye onto fabric by applied heat from a sublimation dye transfer paper, the improvement comprising applying a composition comprising a polyester resin having free carboxyl groups and a hardener selected from the group consisting of isocyanates, epoxides, melamine-formaldehyde and urea-formaldehyde by transfer from the sublimation dye transfer paper to the fabric, in which the polyester resin securely bonds the dye to the fabric to yield a fabric having a soft hand and deep color which is fast to repeated laundering.

12. A sublimable dye transfer printing composition for transfer of the dye onto a fabric by applied heat which comprises a polyester resin having free carboxyl groups, a dye binder and a hardener, selected from the group consisting of isocyanates, epoxides, melamine-formaldehyde and urea-formaldehyde, said polyester resin securely bonding the dye to the fabric to yield a dyed fabric having soft hand and color fastness after repeated laundering, where said dye binder is a polymer of one or more monomers selected from the group consisting of unsaturated aliphatic hydrocarbons, acrylic acid esters, methyl acrylic acid esters, vinyl chloride, vinyl propionate, vinyl isobutyl ether, vinyl acetate, styrene and acrylonitrile.

13. A sublimation dye transfer element for applying a heat sublimable dye to a permanent substrate comprising:

(a) a temporary supporting substrate;

(b) a heat sublimable dye supported by the temporary substrate;

(c) a layer of polyester resin having free carboxyl groups supported by the dye; and (d) a layer containing a dye binder and a hardener disposed on the layer of the polyester resin, where the dye binder is a polymer of one or more monomers selected from the group consisting of unsaturated aliphatic hydrocarbons, acrylic acid esters, methyl acrylic esters, vinyl chloride, vinyl propionate, vinyl isobutyl ether, vinyl acetate, styrene and acrylonitrile, and said hardener is selected from the group consisting of isocyanates, epoxides, melamine-formaldehyde and urea-formaldehyde.

14. In a one step method for sublimation dye transfer printing of a sublimable dye onto fabric by applied heat from a sublimation dye transfer paper, the improvement comprising applying a composition comprising a polyester resin having free carboxyl groups and triglycidylisocyanurate hardener by transfer from the sublimation dye transfer paper to the fabric, in which the polyester resin securely bonds the dye to the fabric to yield a fabric having a soft hand and deep color which is fast to repeated laundering.

15. A sublimation dye transfer element according to claim 13 in which the layer containing a dye binder and a hardener also includes a humectant.

16. The composition of claim 12 where the hardener is triglycidylisocyanurate.

17. The composition of claim 7 where the composition additionally comprises a humectant.

18. The sublimable dye transfer printing composition of claim 7 where the composition additionally comprises a sublimable dye.

* * * * *